United States Patent [19]

Kestner

[11] 4,078,392

[45] Mar. 14, 1978

[54] DIRECT CONTACT HEAT TRANSFER SYSTEM USING MAGNETIC FLUIDS

[75] Inventor: Mark Otto Kestner, Evanston, Ill.

[73] Assignee: Borg-Warner Corporation, Chicago, Ill.

[21] Appl. No.: 755,529

[22] Filed: Dec. 29, 1976

[51] Int. Cl.[2] ..... F25D 17/02; F25B 1/00; F28D 15/00

[52] U.S. Cl. ..... 62/99; 62/114; 62/434; 62/502; 165/107

[58] Field of Search ..... 165/107; 62/434, 99, 62/114, 502; 252/62.52

[56] References Cited

U.S. PATENT DOCUMENTS

| | | | |
|---|---|---|---|
| 2,114,128 | 4/1938 | Smith | 62/502 |
| 2,440,930 | 5/1948 | Camilli et al. | 62/502 |
| 3,156,101 | 11/1964 | McGuffey | 62/434 |
| 3,215,572 | 11/1965 | Papell | 149/2 |
| 3,257,817 | 6/1966 | Leonard, Jr. | 62/502 |
| 3,596,713 | 8/1971 | Katz | 165/107 |
| 3,630,501 | 12/1971 | Shabaker | 165/107 |
| 3,764,540 | 11/1973 | Khalafalls et al. | 252/62.55 |
| 3,843,540 | 10/1974 | Reimers et al. | 252/62.52 |

*Primary Examiner*—Lloyd L. King
*Attorney, Agent, or Firm*—Thomas B. Hunter

[57] ABSTRACT

A direct contact refrigeration system utilizes magnetic fluids, sometimes referred to as ferrofluids, in combination with a suitable refrigerant. The ferrofluid is separated from the refrigerant by magnetic means and circulated to the cooling load. At the same time, the evaporated refrigerant is compressed, condensed and then expanded into direct contact with the warmer ferrofluid returning from the cooling load.

4 Claims, 2 Drawing Figures

DIRECT CONTACT HEAT TRANSFER SYSTEM USING MAGNETIC FLUIDS

BACKGROUND OF THE INVENTION

1. Field of the Invention:

A direct contact heat transfer system using a compatible ferrofluid as a secondary coolant which is separated from the primary fluid by magnetic means.

2. Description of the Prior Art:

G. W. Reimers et al, U.S. Pat. No. 3,843,540 describes methods of making typical magnetic fluids and contains considerable data atea on ferrofluid properties.

S. S. Papell, U.S. Pat. No. 3,215,572 describes the preparation of low viscosity magnetic fluids.

S. E. Khalafalla, U.S. Pat. No. 3,764,540 describes methods of preparing various types of ferrofluids and combinations of ferrofluids in carrier liquids.

None of the above prior art patents suggest or otherwise relate to the use of ferrofluids in direct contact heat transfer systems.

SUMMARY OF THE INVENTION

Conventionally, heat transfer is effected between two fluids of different temperatures by circulating one of the liquids through a length of metallic tubing having a high thermal conductivity which is immersed in a vessel containing the other liquid. Heat is transported radially across the wall of the tubing at a rate determined principally by the thermal conductivities of the two fluids and the wall, the surface area of the tubing, and by the relative flow rates of the two fluid circuits. This method is quite satisfactory and is commonly used in condensers and evaporators of conventional refrigeration equipment.

On the other hand, one would expect direct contact heat transfer between immiscible liquids to be more efficient for two reasons. Firstly, in conventional designs, heat is transferred between liquids in a three step process: from a warmer fluid to a solid wall, through the solid metallic wall, and then from the wall to the colder fluid. In a direct contact system, heat transfer occurs in an essentially one-step process between immiscible fluids with no interfacial boundary resistance to the heat flow. Secondly, an immiscible liquid injected into a refrigerant stream exposes a large area available for heat transfer. This area can be orders of magnitude higher than that exposed by an equivalent weight of copper tubing depending upon the particle size of the injected liquid.

Direct contact heat transfer between immiscible fluids can be easily realized by mixing them together in a container of some type. But, to make the method useful, one must devise a means of efficiently separating the two liquids or their vapors at a rapid rate after heat transfer occurs.

If the two fluids possess different densities, a densiometric method might be used. The liquids are mixed, heat is transferred, followed thereafter by phase separation - the higher density material settling to the bottom of the container where it is pumped off and recirculated.

Other methods of separation such as distillation, filtration or chromatography might be used, but all suffer from the fact that they require either long times, sophisticated equipment, or conditions of temperature and pressure which are not feasible in terms of the overall heat transfer process.

It is known to provide a direct contact heat transfer system in which cold halocarbon refrigerant liquid and warmer water are nozzled into one end of a long heat transfer tube. As the two fluids moved in parallel down the tube, refrigerant evaporated and cooled the water. The refrigerant vapor and cold liquid water leaving the evaporator were separated by a densiometric method in a separate compartment.

Typical results from this type of system established that injecting expanding refrigerant R-114 and water into a heat transfer tube provided volumetric heat transfer coefficents about 100 times those available in conventional water chillers. Moreover, R-114 could be used in direct contact with water in the entire range of operating temperatures and pressures. Because of the very small terminal differences between leaving water and refrigerant evaporating temperatures the efficiency of the R-114 cycle equals or exceeds the efficiency of conventional R-11 cycles.

In spite of the known cost and size benefits derivable from a direct contact system there are several disadvantages which at present limit its usefulness, for example:

1. In addition to the heat transfer tube(s) a separator is required thereby increasing the number of components in the system.
2. Difficulties are encountered in matching the chilled water pressure and refrigerant evaporator pressure.
3. The system cannot operate at high superheat because of the intimate mixing of halocarbon refrigerant and water and the fact that the flow of halocarbon refrigerant and water is parallel.
4. The halocarbon refrigerant had to be completely evaporated before entering the separator. Any liquid halocarbon refrigerant remaining at the end of the heat transfer tube tended to carry under into the base of the separator.
5. Entrainment and crossover of water into the refrigerant and lubricant circuits occurs. Furthermore hydrate formation is often encountered with low molecular-weight halocarbon refrigerant. The water circuit can also be expected to be saturated with refrigerant.
6. Automatic shut down procedures are required so that the compressor will not fill with water during standby periods.

In the present invention, the separation problem is greatly minimized by the use of a ferrofluid as the secondary heat exchange material. These fluids, which can be selected on the basis of a high degree of insolubility in the primary heat transfer fluid (and vice-versa) can be rapidly attracted to a magnetic device which will enable the ferrofluid to be gathered up substantially free of the refrigerant, and circulated back to the load.

DETAILED DESCRIPTION OF THE PREFERRED EMBODIMENT

In its broadest sense, the present invention is directed to a heat transfer system in which a primary fluid is brought into intimate contact with a ferromagnetic fluid which is immiscible with said primary fluid and can be separated therefrom by magnetic means. The primary fluid may be either warmer or colder than the ferrofluid depending on the particular application.

To illustrate a practical system in which a ferrofluid may be employed, a refrigeration system will be described. However, it should be understood that any type of fluid attempering means may be used in the primary fluid circuit. For example, if the system is designed for a heating application, the primary fluid would pass through a heat exchanger having a thermal input. The ferrofluid would then be mixed with the primary fluid to transfer heat to the ferrofluid; and the warm ferrofluid would then be circulated to the load.

Figure 1:
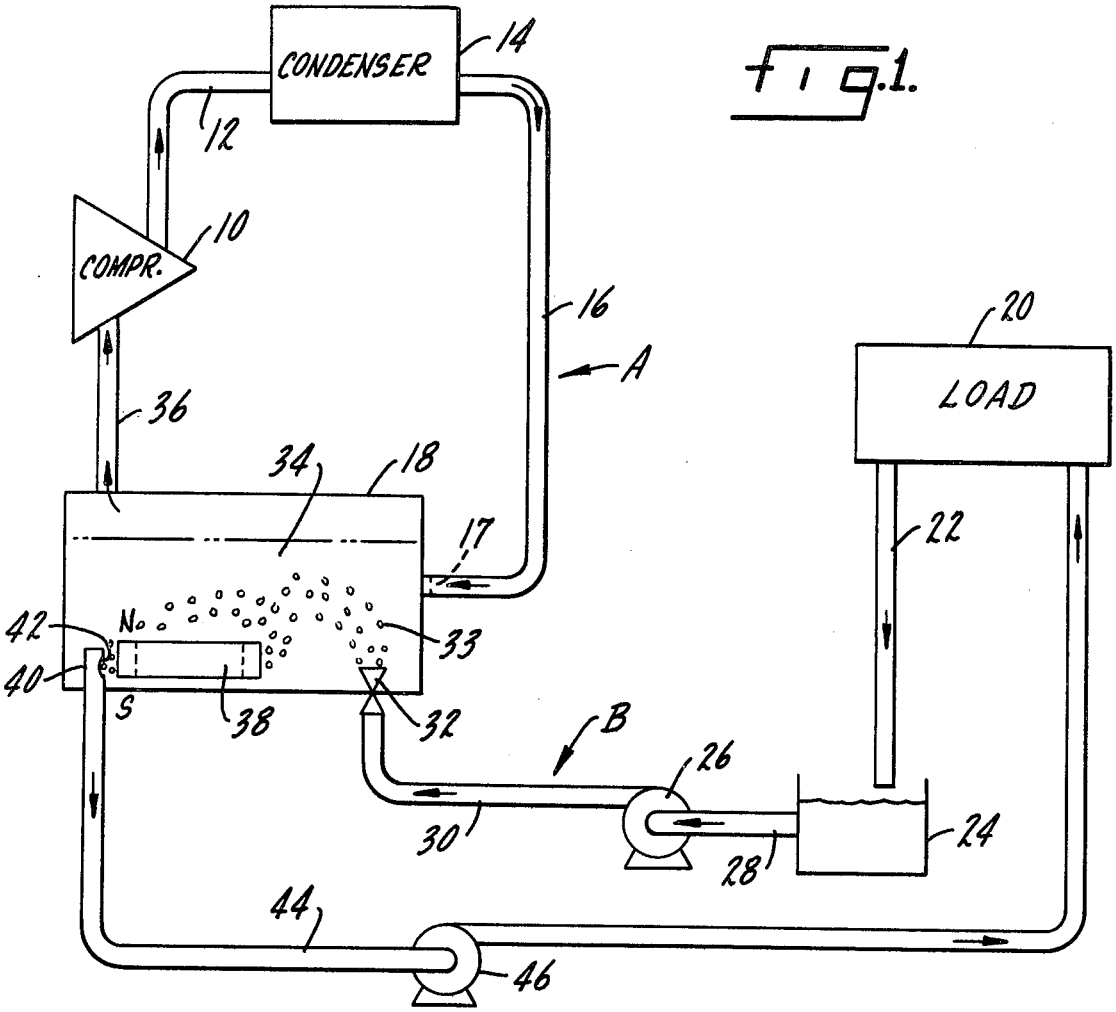
FIG. 1 is a schematic diagram illustrating the principles of the present invention.
Figure 2:
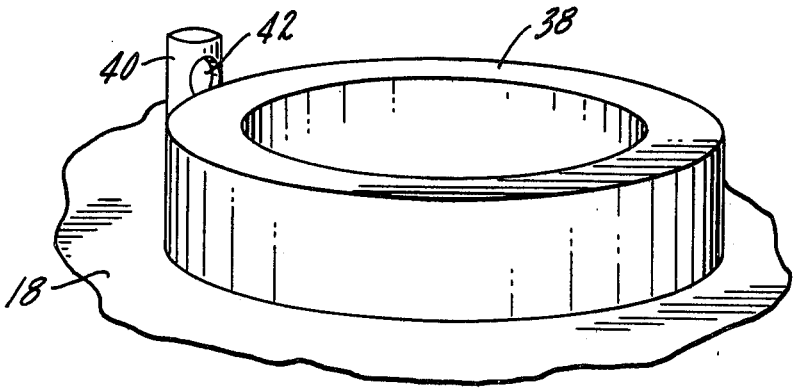
FIG. 2 is a detailed isometric view of the ferrofluid return port and the magnetic device used to attract the ferrofluid in the mixing chamber.

Referring to FIG. 1, there is shown a system which includes two basic fluid loops. In the first loop A, compressor 10 receives refrigerant vapor, at low pressure, and compresses the same, thereafter delivering it at a high pressure and temperature through line 12 to the condenser 14. The condensed high pressure liquid then flows through line 16 containing an orifice 17 or other pressure drop inducing device to a tank 18. There, the refrigerant is brought into contact with the ferrofluid as described in more detail below. The second loop B includes the cooling load 20 having an outlet 22 for circulation to a reservoir 24. A pump 26, connected to reservoir 24 through line 28, delivers the ferrofluid through line 30 to a dispersing device 32 which may be a supersonic or other type of fluid disperser known in the art.

As the small droplets 33 of ferrofluid are dispersed in the liquid refrigerant inside of the mixing tank 18, they are thoroughly mixed therewith and liberate heat to the refrigerant 34 which will, of course, boil. The resulting vapor flows to the suction side of compressor 10 through suction line 36, and the ferrofluid droplets are quickly attracted to a permanent magnet device 38 which is positioned in the lower portion of tank 18. The particles readily gravitate to and collect adjacent the surface of the magnet and from there they are picked up by means of a return tube 40 which has a small aperture 42 formed therein and is closely spaced from the side of the magnet. Virtually all the fluid entering the tube through the aperture will be free of refrigerant. The chilled ferrofluid then flows to the load 20 through line 44 as circulated by pump 46.

While this invention has been described in connection with a certain specific embodiment thereof, it is to be understood that this is by way of illustration and not by way of lim tation; and the scope of the appended claims should be construed as broadly as the prior art will permit.

What is claimed is:

1. A heat transfer system comprising: a first circuit including means for circulating a primary fluid; fluid attempering means for modifying the temperature of said primary fluid; a second circuit including means for circulating a ferromagnetic fluid which is immiscible with said primary fluid to and from a heating/cooling load; means defining a mixing zone in which said primary fluid and said ferromagnetic fluid are brought into direct contact with each other to effect heat transfer therebetween; and magnetic means for attracting said ferromagnetic fluid to induce separation from said primary fluid.

2. A system as defined in claim 1 wherein said fluid attempering means comprises a vapor compression cycle refrigeration system including a compressor, a condenser, and means for expanding refrigerant into said mixing zone.

3. A direct expansion refrigeration system comprising: a first circuit including a compessor,a condenser and an expansion device all connected in series, flow relation for circulating a halcarbon refrigerant; a second circuit including a cooling load and means for circulating a ferromagnetic fluid to and from said cooling load; means defining a mixing zone for bringing said halocarbon refrigerant and said ferromagnetic fluid into direct heat exchange relation with said refrigerant; a magnetic means for attracting said ferromagnetic fluid to effect separation from said refrigerant for return to said second circuit.

4. A method of effecting heat transfer comprising the steps of: intimately mixing a ferromagnetic fluid with a primary fluid which is immiscible with said ferromagnetc fluid to effect direct heat transfer therebetween; attracting said ferromagnetic fluid by magnetic means to separate said ferromagnetic fluid from said primary fluid; directing the separated ferromagnetic fluid to a load.

* * * * *